United States Patent [19]

Ellison

[11] Patent Number: 5,050,056

[45] Date of Patent: Sep. 17, 1991

[54] APPARATUS FOR PRESENTING AN AUDIO SIGNAL TO VISUAL ANALOG DISPLAY

[76] Inventor: Wes Ellison, Rte. 3, Box 215, Baldwin City, Kans. 66006

[21] Appl. No.: 631,471

[22] Filed: Dec. 20, 1990

[51] Int. Cl.[5] ..... F21S 1/00

[52] U.S. Cl. ..... 362/300; 362/306; 362/811

[58] Field of Search ..... 362/298, 300, 306, 806, 362/811; 40/427, 431

[56] References Cited

U.S. PATENT DOCUMENTS

| | | | |
|---|---|---|---|
| 3,238,470 | 3/1966 | Mooney . | |
| 3,538,323 | 11/1970 | Ziegler | 362/806 |
| 3,634,679 | 1/1972 | Krzyston . | |
| 3,772,511 | 11/1973 | Marban . | |
| 4,196,461 | 4/1980 | Geary . | |
| 4,309,746 | 1/1982 | Rushworth . | |
| 4,451,874 | 5/1984 | Friedman . | |
| 4,809,584 | 3/1989 | Forrest . | |
| 4,814,800 | 3/1989 | Lavinsky . | |
| 4,847,739 | 7/1989 | Saraceni | 362/811 |
| 4,887,197 | 12/1989 | Effinger . | |

*Primary Examiner*—Carl D. Price
*Assistant Examiner*—Richard R. Cole
*Attorney, Agent, or Firm*—Hovey, Williams, Timmons & Collins

[57] ABSTRACT

An apparatus (10) for presenting shiftable light patterns includes a translucent globe (12), a convex redirecting mirror (16) mounted adjacent the upper interior surface of the globe (12), a laser beam source (20), a pair of galvanic vibration mirrors (22,24), and amplifier assembly (28) for vibrating the mirrors (22,24) in accordance with a respective pair of stereophonic audio signals (22,24). In operation, the vibration mirrors operate to change the impingement location of the beam on the reflecting mirror in direction in transverse to one another and in accordance with the amplitude and frequency of the audio signals resulting in light patterns which shift in accordance with the audio signals.

17 Claims, 3 Drawing Sheets

APPARATUS FOR PRESENTING AN AUDIO SIGNAL TO VISUAL ANALOG DISPLAY

BACKGROUND OF THE INVENTION

1. Field of the Invention

The present invention is concerned with an apparatus for presenting shiftable light patterns. More particularly, the present invention concerns an apparatus preferably having a translucent globe, a convex redirecting mirror mounted adjacent the upper interior surface of the globe, a laser beam source, a pair of galvanic vibration mirrors, and a amplifier assembly for vibrating the mirrors in accordance with a respective pair of stereophonic audio signals in order to present light patterns which shift in accordance with the audio signals.

2. Description of the Prior Art

The prior art discloses devices which shift a light beam, such as a laser beam, in order to present shiftable light patterns. For example, U.S. Pat. No. 4,196,461 discloses an entertainment device which uses rotating mirrors to redirect a laser beam onto a window and thereby provide moving patterns. Similarly, U.S. Pat. No. 3,634,679 discloses a lighting apparatus which uses a rotating multi-faceted jewel to disperse a focus light beam onto a screen or frosted globe. Neither of these prior art devices, however, shift light patterns in accordance with music signals and thereby do not provide a visual analog thereto.

SUMMARY OF THE INVENTION

The present invention solves the prior art problems outlined above and provides a distinct advance in the state of the art. More particularly, the invention hereof provides a device for shifting light patterns in a unique way in accordance with musical audio signals in order to produce a visual analog display.

The preferred embodiment includes a laser beam source, a translucent globe, a convex redirecting mirror mounted adjacent the upper interior surface of the globe, a pair of vibrating mirrors, and a amplifier assembly for vibrating the mirrors in accordance with preferred stereophonic audio signals received from a source thereof. In operation, the impingement locations of the laser beam on the interior surfaces of the globe vary according to the amplitudes and frequencies of the signals.

DESCRIPTION OF THE PREFERRED EMBODIMENT

Figure 1:
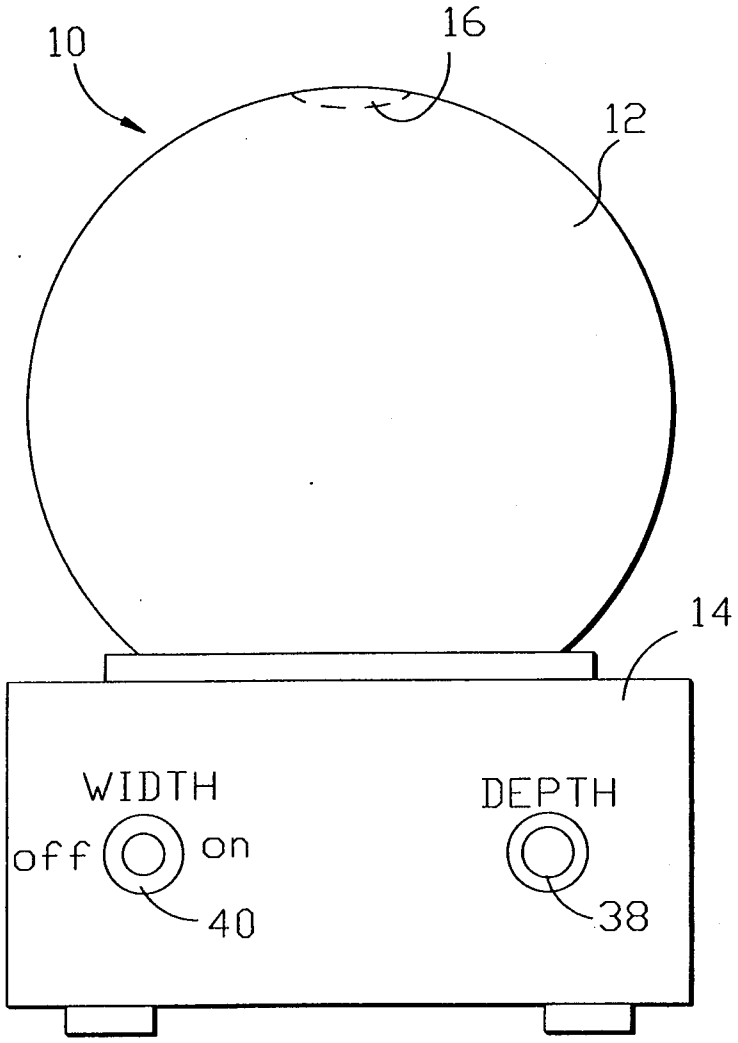
FIG. 1 is a front elevational view of the preferred apparatus.
Figure 2:
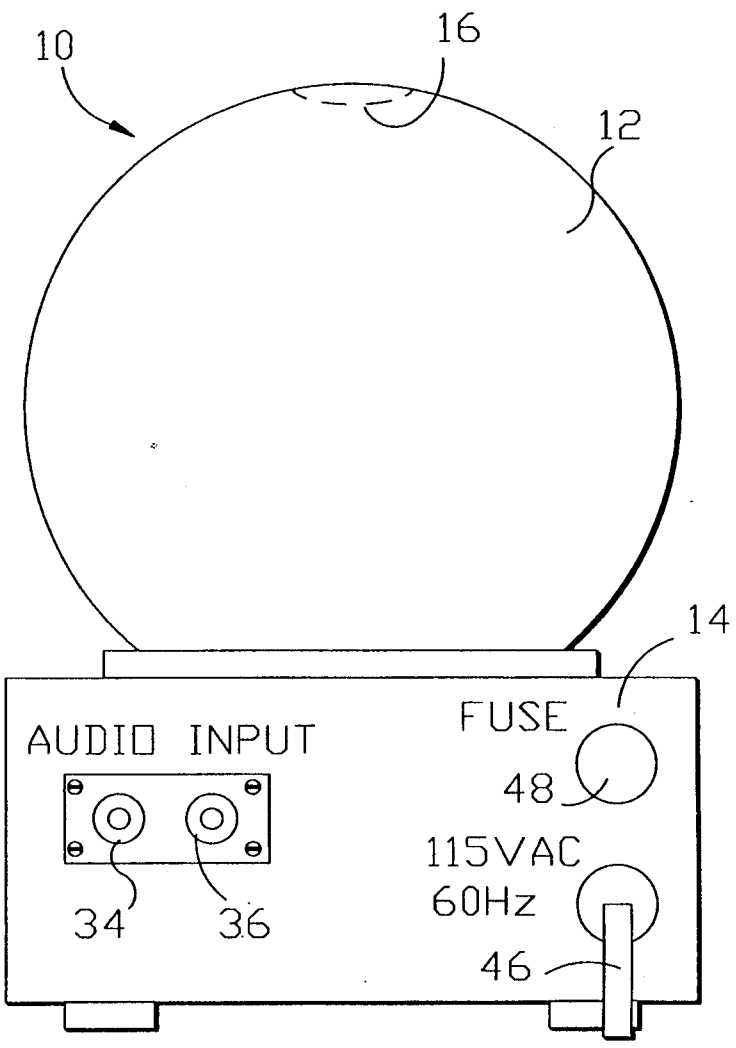
FIG. 2 is a rear elevational view of the preferred apparatus.
Figure 3:
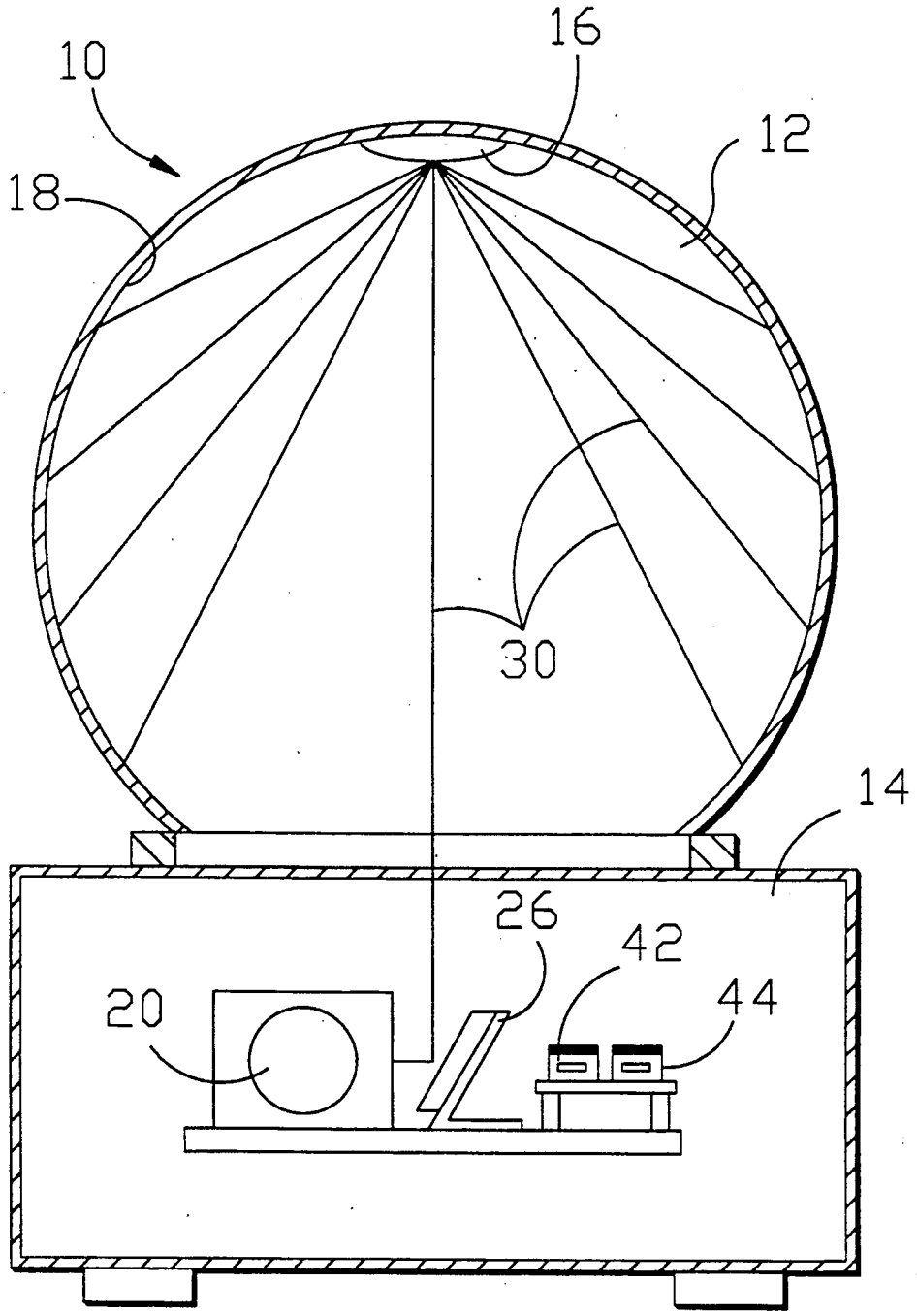
FIG. 3 is a schematic representation of the apparatus illustrating various beam impingement locations on the interior surfaces of the apparatus globe.

Referring to the drawing figures, preferred apparatus 10 includes translucent globe 12 and base 14. Globe 12 presents a frusto-spherical configuration with the flattened portion thereof being open and resting on and coupled with base 14 as illustrated in FIGS. 1–3. Convex reflecting mirror is mounted adjacent the upper interior surface of globe 12 and centered on the central axis thereof as shown in FIG. 3. In this position, reflector mirror 16 is operable to reflect a beam of light onto interior surfaces 18 of globe 12.

Figure 4:
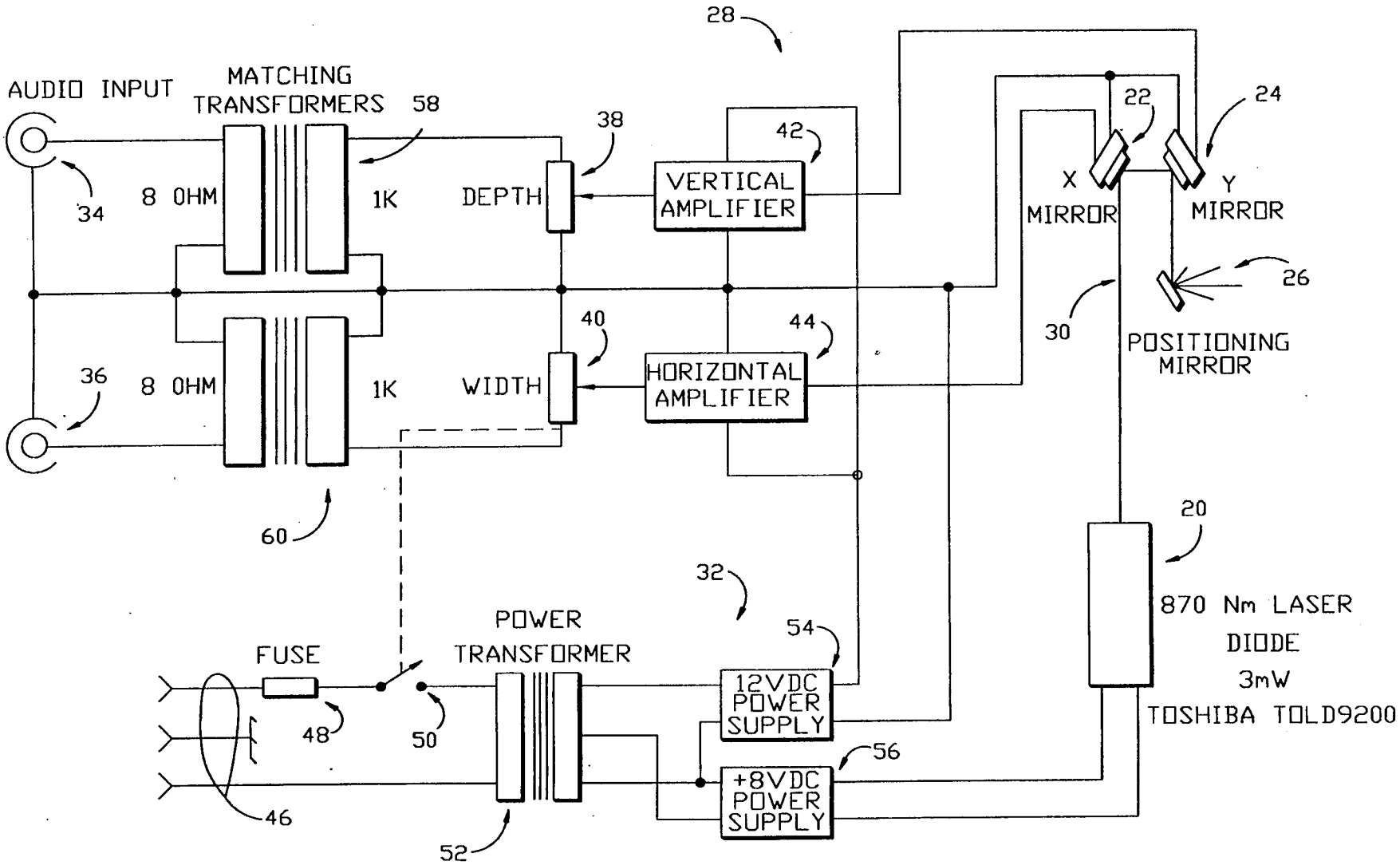
FIG. 4 is a block diagram illustrating the preferred amplifier assembly, laser beam source, vibration mirrors, and positioning mirror.

Base 14 encloses laser beam source 20 (670 nm laser diode with collimator), X-Y oriented galvanic vibration mirrors 22 and 24, positioning mirror 26, and amplifier assembly 28. Mirrors 22–26 are positioned in the path of laser beam 30 emitted by source 20 so that beam 30 initially strikes X-mirror 22, is reflected to Y-mirror 24, and then reflected to positioning mirror 26 (FIG. 4) and from there upwardly along the central axis of globe 12 to impinge on reflector mirror 16 (FIG. 3). As explained further hereinbelow, vibration of mirrors 22, 24 causes laser beam 30 to shift which causes laser beam 30 to impinge various locations on interior surfaces 18.

Amplifier assembly 28 includes power supply 32, left and right channel audio inputs 34 and 36, depth and width rheostats 38 and 40, and vertical and horizontal amplifiers 42 and 44. Power supply 32 receives operating power at 115 VAC by way of conventional electrical cord 46, fuse 48, on/off switch 50 ganged with width rheostat 40, and power transformer 52. Operating power is then delivered from transformer 52 to conventional 12 VDC power supply 54 and 8 VDC power supply 56. Power supply 54 delivers output power at 12 VDC to operate amplifiers 42 and 44, and power supply 56 delivers output power at 8 VDC to operate laser source 20.

Audio inputs 34 and 36 are configured to receive vibration signals as conventional stereophonic audio signals by way of standard jacks. The inputs are delivered by way of respective input transformers 58 and 60 (8 ohm to 1K ohms each) to rheostats 38, 40 which are manually adjustable to vary the signal strength to amplifiers 42, 44. The amplified pairs of audio signals are delivered respectively to vibration mirrors 22, 24 which respond by vibrating in directions normal to the reflecting planes thereof.

Mirror 22 is oriented so that vibration thereof results in shifting of laser beam 30 between opposed sides of the central axis of globe 12 in one direction, i.e. the X direction. Mirror 24 is oriented so that the vibration thereof shifts laser beam 30 from the central axis of globe 12 in the Y direction transverse to the X direction. As the impingement locations of beam 30 on reflecting mirror 16 move further from the central axis of globe 12, the curved surface of mirror 16 redirects beam 30 to locations higher up the sides of globe 12.

In use and operation, left channel signals received at input 34 vibrate Y-direction mirror 24 which in turn causes laser beam 30 to shift between opposed sides of the globe axis represented as in and out of the page of FIG. 3. The magnitude of the shifting is determined by the amplitude of the input signal and by the amplification provided by amplifier 42 as controlled by rheostat 38. The frequency of the shifting is determined of the frequency of the audio signal. Similarly, right channel signals receive input 36 vibrate X-direction mirror 32 which in turn causes laser beam 30 to shift between opposed sides of the globe axis represented as the left and right directions in FIG. 3. The magnitude of the shifting is determined by the amplitude of the audio signal and the amplification provided by amplifier 24 as controlled by rheostat 40. The frequency of the shifting is determined by the frequency of the right channel audio channel.

As will be appreciated from the above description, apparatus 10 provides a unique and striking audio signal to visual analog display and in particular to music signals. The preferred laser provides a red beam which is transmitted and diffused by the contrasting white translucent walls of globe 12. When the audio inputs are presented at low amplitude and low frequency, laser beam 30 is shifted a corresponding low magnitude from the globe axis at a low frequency which presents the effect of a gently flickering red glow at the base of globe 12.

As the amplitudes of the input signals increase, the shifting impingement locations of beam 30 on redirecting mirror 16 move further from the globe axis on the curvature of mirror 16 which, in turn, causes the beam impingement locations on globe interior surfaces 18 to move further up the sides of globe 12. As a result, the size of the red glow emanating from globe 12 increases to cover a larger area and, when combined with higher audio frequencies accompanying a more intense music passage, for example, the effect of the raging fire storm is presented. Independent control of the transverse X and Y directions of laser beam 30 provides a visually moving, three-dimensional effect which can be adjusted by the user to further enhance the analogous nature of the display.

As those skilled in the art will appreciate, the present invention encompasses many variations in the preferred embodiment described herein. For example, different color laser beams could be used. Furthermore, the present invention could include two separate laser beams presenting contrasting colors. While it is preferred to use stereophonic audio signals as the vibration signals, other signal generators could be used equivalently and the preferred apparatus could be designed for only one source of input signals. Additionally, an internally generated source of vibrations signals could be provided, as well as a microphone for voice actuation.

Having thus described the preferred embodiment of the present invention, the following is claimed and new and desired to be secured by Letters Patent.

I claim:

1. An apparatus for presenting shiftable light patterns comprising:

a source of a beam of light;

a housing having substantially surrounding translucent wall presenting interior surfaces for transmitting and diffusing light impinging on said surfaces for viewing exteriorly of said housing and substantially therearound;

a redirecting mirror mounted stationary relative to said housing and positioned for redirecting said light beam onto said interior surfaces;

at least one vibration mirror including means for mounting said mirror in the path of said beam and positioning said mirror for reflecting said beam onto said redirecting mirror; and vibration means coupled with said vibration mirror for receiving vibration signals from a source thereof and for vibrating said vibration mirror in accordance with said signals, said vibration mirror being operable for shifting the impingement location of said beam on said redirecting mirror in accordance with said vibrating, said redirecting mirror presenting a curved surface and being operable for shifting the impingement position of said beam on said interior surfaces in accordance with the shifting of the beam impingement location of redirecting mirror and in accordance with the curvature thereof for thereby presenting shiftable light patterns.

2. The apparatus as set forth in claim 1, said beam including a collimated beam of light.

3. The apparatus as set forth in claim 2, said collimated beam including a laser beam.

4. The apparatus as set forth in claim 1, said housing walls being configured to present a globe.

5. The apparatus as set forth in claim 4, said globe presenting an upper interior surface, said apparatus further including means for mounting said redirecting mirror within said globe and adjacent said upper interior surface thereof.

6. The apparatus as set forth in claim 5, said redirecting mirror including a convex mirror.

7. The apparatus as set forth in claim 6, said vibration signals presenting respective amplitudes and frequencies, said vibration means, vibration mirror, redirecting mirror and housing being configured such that the magnitude of shifting of said beam varies in correlation with said amplitudes, and the frequencies of shifting of said beam vary in correlation with said signal frequencies.

8. The apparatus as set forth in claim 1, said housing presenting an upper interior surface, said apparatus further including means for mounting said redirecting mirror in said housing adjacent said upper interior surface thereof.

9. The apparatus as set forth in claim 1, said redirecting mirror including a convex mirror.

10. The apparatus as set forth in claim 9, said redirecting mirror presenting a central axis, said vibrating mirror being mounted for reflecting said beam along said central axis.

11. The apparatus as set forth in claim 1, said vibrating mirror including a galvanic mirror.

12. The apparatus as set forth in claim 1, further including a second vibration mirror mounted in the path of said beam, said mirrors being configured for shifting the impingement location of said beam on said redirecting mirror in respectively transverse directions.

13. The apparatus as set forth in claim 12, said vibration signals including a pair of stereophonic audio signals, said vibration means including means for vibrating said mirrors respectively in accordance with said pair of signals.

14. The apparatus as set forth in claim 1, said vibration signals presenting respective amplitudes and frequencies, said vibration means, vibration mirror, redirecting mirror and housing being configured such that the magnitude of shifting of said beam varies in correlation with said amplitudes, and the frequencies of shifting of said beam varies in correlation with said signal frequencies.

15. The apparatus as set forth in claim 1, said vibration means including amplifier means for amplifying said vibration signals.

16. The apparatus as set forth in claim 1, said vibration signals including audio signals.

17. An apparatus for presenting shiftable light patterns comprising:

a source of a beam of laser light;

a globe having translucent walls and presenting interior surfaces for transmitting and diffusing light impinging thereon for viewing exteriorly of said globe, said globe presenting a central vertical axis and an upper interior surface;

a convex redirecting mirror mounted stationary relative to said globe and positioned adjacent said upper interior surface thereof with said axis passing centrally therethrough for redirecting said light beam onto said interior surfaces;

a pair of vibration mirrors including means mounting said mirrors in the path of said beam and positioning said mirrors for reflecting said beam onto said redirecting mirror; and vibration means coupled with said mirrors for receiving a pair of audio signals from sources thereof and for vibrating said vibration mirrors respectively in accordance with said pair of signals, said vibration mirrors being configured and operable for changing the impingement location of said beam on said redirecting mirror in directions transverse to one another and in accordance with said signals.

* * * * *